US005368660A

United States Patent [19]

Durlu et al.

[11] Patent Number: 5,368,660

[45] Date of Patent: Nov. 29, 1994

[54] HIGH TEMPERATURE $TIAL_2$-BASED TERNARY ALLOYS

[75] Inventors: Nuri Durlu, Ankara, Turkey; Osman T. Inal, Socorro, N. Mex.

[73] Assignee: New Mexico Tech Research Foundation, Socorro, N. Mex.

[21] Appl. No.: 969,755

[22] Filed: Oct. 30, 1992

[51] Int. Cl.[5] ..... C22C 14/00

[52] U.S. Cl. ..... 148/421; 420/418; 420/421

[58] Field of Search ..... 148/421; 420/418, 421

[56] References Cited

U.S. PATENT DOCUMENTS

| | | | |
|---|---|---|---|
| 2,464,836 | 3/1949 | Thomas, Jr. et al. | 219/8 |
| 2,750,271 | 6/1956 | Cueilleron et al. | 75/0.5 |
| 2,919,189 | 12/1959 | Nossen et al. | 75/135 |
| 3,020,154 | 2/1962 | Ida et al. | 75/138 |
| 3,391,999 | 7/1968 | Cole et al. | 23/204 |
| 4,347,076 | 8/1982 | Ray et al. | 75/0.5 R |
| 4,865,666 | 12/1989 | Kumar et al. | 148/437 |
| 4,891,184 | 1/1990 | Mikkola | 420/553 |
| 5,006,054 | 4/1991 | Nikkola | 420/552 |

FOREIGN PATENT DOCUMENTS

| | | |
|---|---|---|
| 221972 | 1/1958 | Australia . |
| 0154485 | 9/1904 | Germany . |

OTHER PUBLICATIONS

Seibold, A. Z. Metallkde, 72 (1981) 712.

Raman et al Z. Metallkde, 56 (1965) 99.

Schuster et al Z. Metallkde, 81 (Jun. 1990) 389.

Abdel-Hamid Z. Metallkde, 82 (May 1991) 383.

Bickerdike, R. L., et al., "Microstructures and Tensile Properties of Vapor Deposited Aluminum Alloys" *Int. J. Rapid Solidif,* vol. 1 (4) pp. 305-325 (1986) Abstract from *Chem Abst.* 1986.

Durlu, Nuri, "A Study on Aluminum-Rich Titanium Aluminides of Iron and Nickel" Thesis, New Mexico Institute of Mining and Technology, 1991.

Durlu, Nuri, et al., "Phase Relations in $TiAl_2$-based Ternary Titanium Aluminides of Iron or Nickel" *Materials Science and Engineering* A152, pp. 67-75 (1992).

Durlu, N., et al., "$L1_2$-type Ternary Titanium Aluminides as Electron Concentration Phases" *J. Mat. Sci.* vol. 27, pp. 3224-3230 (1992).

Durlu, N., et al., "$L1_2$-type Ternary Titanium Aluminides of the Composition $Ti_{25}X_8Al_{67}$:$TiAl_3$-Based or $TiAl_2$-Based?" *Scripta Metallurgica et Materialia,* vol. 25, pp. 2475-2479 (1991).

Durlu, N., et al., "Study on $TiAl_2$-Based Ternary (Fe or Ni) Titanium Aluminides" *J. of Mat. Sci.,* vol. 27, pp. 1175-1178 (1992).

Huang, S. C., et al., "Rapidly Solidified $Al_3Ti$-Base Alloys Containing Ni", *J. Mater. Res.,* vol. 3, No. 1, (Jan./Feb. 1988).

Kumar, K. S., et al., "Compression Behavior of the $L1_2$ Intermetallic $Al_{22}Fe_3TI_8$" *Scripta Metallurgica,* vol. 22, pp. 1015-1018 (1988).

Mabuchi, Hiroshi, "Aluminide Coatings of TiAl Compound" *Scripta Metallurgica,* vol. 23, pp. 685-689 (1989).

(List continued on next page.)

*Primary Examiner*—Upendra Roy

*Attorney, Agent, or Firm*—Rod D. Baker; Deborah A. Peacock

[57] ABSTRACT

Two phase, $TiAl_2$-based, ternary aluminides of iron, nickel and other transitional metals are disclosed. A transformation from the tetragonal crystal configurations of the TI—Al system to the face-centered cubic configurations of the TI—Al—Fe and TI—Al—Ni systems is attributed to the transitional elements substituting for titanium in the face-centered cubic crystal lattice of the titanium aluminides. The resulting alloys of the composition $Ti_{30}M_4Al_{66}$ or $Ti_{25}M_9Al_{66}$, including $Ti_{30}Fe_4Al_{66}$ and $Ti_{30}Ni_4Al_{66}$, are low density, high temperature, aluminum-rich alloys possessing desirable properties, including ductility.

7 Claims, No Drawings

OTHER PUBLICATIONS

Munroe, P. R., "The Effect of Scandium of the Crystal Structure of $Ti_3Al$" *Scripta Metallurgica et Materialia,* vol. 27, pp. 1373–1378 (1992).

Nic, J. P., "Observations on the Systematic Alloying of $Al_3Ti$ with Fourth Period Elements to Yield Cubic Phases" *Scripta Metallurgica et Materialia,* vol. 24, pp. 1099–1104 (1990).

Omarov, A. K., et al, "Phase Structure of Aluminum--Nickel-Titanium System Alloys at 1150–1600°", *Izu. Akad. Nauk Kaz. SSR, Ser. Khim* vol. 1, pp. 36–42 (1985) Abstract from Chm Abstr., vol. 102 (1985).

Winnicka, M. B., "Microstructure and Ordering of $L1_2$ Titanium Trialuminides" *Metallurgical Transactions A,* vol. 23A pp. 2963–2972 (1992).

Winnicka, M. B., et al., "Structure and Compression Behaviour of the $L1_2Al_5CuTi_2$ Intermetallic Compound" *Scripta Metallurgica,* vol. 23, pp. 1199–1202 (1989).

Van Vucht, J. H. N., "Influence of Radius Ratio on the Structure of Intermetallic Compounds of the $AB_3$ Type" *J. Less-Common Metals,* vol. 11, pp. 308–322 (1966).

Van Vucht, J. H. N., et al., "The Structures of the Rare-Earth Trialuminides", *J. Less-Common Metals.,* vol. 10, pp. 98–107 (1965).

Zhang, S., et al., "New Cubic Phases Formed by Alloying $Al_3Ti$ with Mn and Cr", *Scripta Metallurgica et Materialia,* vol. 24, pp. 57–62 (1990).

HIGH TEMPERATURE $TIAL_2$-BASED TERNARY ALLOYS

BACKGROUND OF THE INVENTION

1. Field of the Invention (Technical Field):

The invention relates to two-phase ternary alloy compositions based on titanium aluminides.

2. Background Art:

Manufacturing industries, particularly the aerospace industry, are in constant need of construction materials that are lightweight, strong, and corrosion and oxidation resistant at high temperatures. It has been recognized in the art that intermetallic aluminides are one of the more promising groups of materials potentially satisfying these requirements while also meeting desirable cost criteria. Aluminum-rich intermetallic alloys, such as titanium trialuminide ($TiAl_3$), have received substantial attention for their low density and their ability to retain high strength at extreme temperatures. Unfortunately, aluminum-rich intermetallic alloys generally have exhibited brittleness at ambient temperatures. Brittleness in intermetallic aluminides can be attributed primarily to complex and asymmetrical crystal structures; complex crystal structures have an insufficient number of slip systems, which limit bulk deformation behavior. Other reasons (e.g., impeded cross slip, poor intergranular bonding) also contribute to a tendency toward inherent brittleness and low ductility in intermetallic aluminide alloys. Low ductility will render aluminide compositions unacceptable for structural applications.

The intermetallic alloy $TiAl_3$ is specifically known in the art to have high strength, high hardness, and good heat and oxidation resistance, but also is known to be extremely brittle at ambient temperatures. Some efforts to overcome this shortcoming of an otherwise desirable alloy have been in the area of processing technology. Improved processing methods have not, however, adequately enhanced ductility, a failure most probably attributable to the tetragonal (commonly denoted as $DO_{22}$) crystal structure of $TiAl_3$. Tetragonal crystal structures are among those having less than the requisite number of slip systems necessary for polycrystalline deformation ductility.

It is known that alloys with the symmetric cubic crystal structure ($L1_2$) possess the required number of slip systems to permit appreciable ductility. It has also been supposed that tetragonal $TiAl_3$ can be transformed into the more ductile cubic $L1_2$ crystal structure by the ternary addition of other metallic elements.

U.S. Pat. No. 5,006,054 to Mikkola and U.S. Pat. No. 4,891,184 to Mikkola are related patents disclosing low density, high temperature, aluminum-rich alloys based on modifications of $TiAl_3$ compositions. The '054 patent teaches the transformation of tetragonal $TiAl_3$ to the symmetrical cubic $L1_2$ phase through the addition of manganese and/or chromium to the alloy. The transformation of tetragonal crystal $TiAl_3$ to cubic crystal $L1_2$ is presumed and taught. The '054 and '184 patents contain helpful discussion of the state of the art of preparing ternary alloys of aluminum.

U.S. Pat. No. 4,865,666 to Kumar, et al., discloses ternary alloys of $TiAl_3$ which display the $L1_2$ cubic structure. Essentially single-phase compositions are disclosed. The '666 patent teaches toward compositions having between eight and fourteen percent atomic weight of Cu, Fe, Co and Ni. The disclosure includes numerous helpful citations to and discussion of past efforts in the art.

U.S. Pat. No. 4,347,076 to Ray, et al., discloses a method of fabricating aluminum alloys using a rapid solidification production processing technique. The rapid solidification process permits the manufacture of very fine powders of aluminum alloys containing various transition metals, which are then consolidated and heat treated to improve their physical properties. No crystal transformation from titanium aluminides is taught, and when Fe is the transition metal of choice, it is included at ten to fifteen weight percent.

U.S. Pat. No. 3,391,999 to Cole, et al., discloses a process for preparing metal aluminides, including titanium aluminide, by reacting the metal with metallic aluminum in a molten salt. The resulting product is brittle, and there is no teaching toward construction uses. There is no disclosure of ternary alloys incorporating Fe or Ni within an $L1_2$ crystal structure.

U.S. Pat. No. 3,020,154 to Ida discloses a ternary alloy of Al—Ni—Ti, conventionally prepared, where the Ni is between 0.5 and 5.0 weight percent, and the Ti is between 0.5 and 3.5 weight percent.

U.S. Pat. No. 2,919,189 to Nossen, et al., discloses a production process for preparing alloys of refractory metals such as titanium. There is no teaching toward transformation of titanium aluminides to the $L1_2$ structure by the addition of transition metals.

U.S. Pat. No. 2,750,271 to Cueilleron, et al., discloses a method of preparing Al—Ti alloys; no ternary alloys are taught.

U.S. Pat. No. 2,464,836 to Thomas, et al., discloses an alloy for use in welding rods which may include Al, Fe, Ni and Ti. No structural uses for the alloy are indicated.

German Patent No. 154,485 discloses an Al—Ni—Ti alloy.

Australian Patent No. 221,972 discloses an aluminum alloy containing 0.5 to 2.5 weight percent Ni and 0.1 to 0.3 weight% Ti, the balance being substantially Al. The Australian patent teaches toward the addition of 1.5 weight % or less of Fe or other metals to increase strength.

K. S. Kumar and J. R. Pickens report the preparation of a ternary intermetallic alloy, $Al_{22}Fe_3Ti_8$, which demonstrated favorable compression strength characteristics. The tensile strength and ductility of the alloy were not disclosed. Kumar, K. S. and Pickens, J. R., "Compression Behavior of the $L1_2$ Intermetallic $Al_{22}Fe_3Ti_8$," *Scripta Metallurgica*, Vol. 22, pp. 1015–1018 (Pergamon Press, 1988).

S. C. Huang, E. L. Hall and M. F. X. Gigliotti discuss a method of rapid solidification processing to prepare $TiAl_3$-based alloys containing nickel. S. C. Huang, et al., "Rapidly Solidified $Al_3Ti$-base Alloys Containing Ni," *Journal of Materials Research*, Vol. 3, No. 1, pp. 1–7 (1988).

M. B. Winnicka and R. A. Varin have prepared, and evaluated the compressive ductility of, an intermetallic compound of the Ti—Al—Cu system. M. B. Winnicka and R. A. Varin, "Structure and Compression Behaviour of the $L1_2$ $Al_5CuTi_2$ Intermetallic Compound," *Scripta Metallurgica*, Vol. 23, pp.1199–1202 (Pergamon Press, 1989).

S. Zhang, J. P. Nic and D. E. Mikkola disclose the formation of cubic crystal alloy phases composed by alloying $TiAl_3$ with chromium and manganese, with a minimum of second phases. S. Zhang, et al., "New Cubic Phases Formed By Alloying $Al_3Ti$ With Mn and Cr," *Scripta Metallurgica*, Vol. 24, pp. 57–62 (Pergamon Press, 1990).

J. P. Nic, S. Zhang and D. E. Mikkola disclose certain structure and property research findings pertaining to certain ternary alloys of $TiAl_3$ with Cr, Mn, Fe, Co, Ni, Cu and Zn. J. P. Nic, et al., "Observations on the Systematic Alloying of $Al_3Ti$ With Fourth Period Elements to Yield Cubic Phases," *Scripta Metallurgica*, Vol. 24, pp. 1099–1104 (Pergamon Press, 1990).

The present invention is better understood with reference to the atomic radius ratio criterion theories expounded by J. H. N. Van Vucht and K. H. J. Buschow. J. H. N. Van Vucht and K. H. J. Buschow, *Journal of Less Common Metals*, Vol. 10, pp. 98–103 (1965) and *Journal of Less Common Metals*, Vol. 11, pp. 308–313 (1966).

X-ray diffraction research useful in understanding the results obtained in the examples of the present invention were performed by Hiroshi Mabuchi and colleagues. H. Mabuchi, T. Asai and Y. Nakayama, "Aluminide Coatings on TiAl Compound," *Scripta Metallurgica*, Vol. 23, pp. 685–689 (Pergamon Press, 1989).

N. Durlu, O. T. Inal (the Applicants), and F. G. Yost include a very brief discussion of the invention in introductory remarks to an article on a related subject. N. Durlu, et al., "$L1_2$-Type Ternary Titanium Aluminides of the Composition $Ti_{25}X_8Al_{67}$: $TiAl_3$-Based or $TiAl_2$-Based?," *Scripta Metallurgica*, Vol. 25, pp. 2475–2479 (Pergamon Press 1991).

N. Durlu, co-Applicant, teaches many aspects of the present invention in his doctoral dissertation. N. Durlu, Dissertation for the PhD. Degree, "A Study on Aluminum-rich Titanium Aluminides of Iron and Nickel," New Mexico Institute of Mining and Technology Library, which is incorporated herein by reference.

The present invention is disclosed by the Applicants in a recent journal article, including microphotographs of the crystalline structures of the alloys, which is incorporated herein by reference. N. Durlu and O. T. Inal, "Study on $TiAl_2$-Based Ternary (Fe or Ni) Titanium Aluminides," *Journal of Materials Science*, Vol. 27, pp.1175–1178 (Chapman & Hall, 1992).

SUMMARY OF THE INVENTION (DISCLOSURE OF THE INVENTION)

The invention relates to compositions of and methods for making two-phase ternary titanium aluminide alloys of the composition $Ti_aX_bAl_c$, where X is chromium, manganese, iron, cobalt, nickel, copper, palladium, silver, or gold, and a is between twenty-five and thirty-five, b is between one and ten, and c is between sixty and seventy. In the preferred embodiments of the composition, the ternary element is either iron or nickel, although the other aforementioned transition elements may be advantageously utilized to adapt the invention to particularized applications. In the preferred embodiments, a is thirty, b is four, and c is sixty-six. Desirable ductility is observed in the compositions of the invention without the addition of any quaternary elements, despite previous inferences in the art that quaternary chromium or manganese is required for ductility.

The inventive composition is two-phase, exhibiting the presence of $TiAl_2$ and $L1_2$ microstructures. The compositions demonstrate desirable ductility, and the two-phase character of the compositions offers hardness and creep resistance previously unreported in the art.

The method of the invention comprises a method of making a two-phase $TiAl_2$ and $L1_2$ type ternary titanium aluminide alloy of the composition $Ti_{34-x}M_xAl_{66}$, the method comprising the steps of selecting the ternary element M from a group consisting of chromium, manganese, iron, cobalt, nickel, copper, palladium, silver and gold; determining respective proportions of titanium, ternary element and aluminum in the alloy by choosing the atomic weight percent variable x from a number group consisting of the numbers one through nine; arc melting high-purity titanium, ternary element, and aluminum together in a copper hearth under an argon atmosphere to form at least one ingot; annealing the ingot for between eight and twelve days at a temperature between 1250° K. and 1350° K. in a vacuum of $1\times10^{-5}$ torr; and furnace cooling the ingot.

An object of the invention is the provision of an ordered intermetallic alloy that is lightweight, ductile, and crack-resistant for use in high-temperature structural applications.

Another object of the invention is the provision of a ductile alloy of titanium aluminides.

An advantage of the invention is that it exhibits the high-temperature strength of titanium aluminides without exhibiting unacceptable brittleness.

Another advantage of the invention is that it is a two-phase composition, and thus is resistant to mechanical creep and may be heat-treated to improve other mechanics of materials properties.

Another advantage of the invention is that the ternary element may be varied to adapt the composition to particular applications.

Another advantage of the invention is that the ternary element may be varied to adapt the composition to particular applications.

Other objects, advantages, and novel features, and further scope of applicability of the present invention will be set forth in part in the detailed description to follow, and in part will become apparent to those skilled in the art upon examination of the following, or may be learned by practice of the invention. The objects and advantages of the invention may be realized and attained by means of the instrumentalities and combinations particularly pointed out in the appended claims.

DESCRIPTION OF THE PREFERRED EMBODIMENTS (BEST MODES FOR CARRYING OUT THE INVENTION)

This invention relates to a novel two-phase alloy of ordered intermetallic compounds, including ternary alloys of aluminum and titanium. In the preferred embodiment, iron or nickel is added as the ternary element to a titanium aluminide. The resulting alloy displays the desirable traits of titanium aluminides, such as resistance to oxidation and high strength at high temperature, but does not display the unacceptable brittleness common to titanium-aluminum alloys. The alloy is two-phase, with both $L1_2$-type and $TiAl_2$-type crystal structures observed. Two-phase microstructure promotes creep resistance and heat treatability.

Ordered intermetallic compounds, especially aluminides, offer substantial potential as construction materials for high-temperature applications. In this specification, "ordered intermetallics," shall mean alloys having two or more species of atoms occupying specific locations in the crystal lattice. The desirability of aluminides for high-temperature applications is attributable to a variety of favorable properties. Among them are: the strong bonding which results in an invariant modulus; a high activation energy for diffusion, which discourages diffusion-dependent mechanisms such as creep and fatigue at elevated temperatures; and resistance to oxidation due to high aluminum content. Heretofore, intermetallic compounds generally have displayed unacceptably low ductility at ambient temperatures, thus limiting their use in structures with high-temperature applications.

Among the intermetallics presently being evaluated as possible construction materials, $Ti_3Al$, TiAl and $TiAl_3$ have the lowest density, and are attractive candidates for intermediate and high temperature applications where lightweight, high-strength materials are required. Past evaluations have focused primarily upon $Ti_3Al$ and TiAl as potential alloy components, with $TiAl_3$ receiving comparatively less, but not insubstantial, attention. This comparative disinterest is likely a result of the limited solubility of $TiAl_3$, which renders its physical processing somewhat more difficult. While sharing with $Ti_3Al$ and TiAl the brittleness characteristic, $TiAl_3$ has the lowest density (3.37 g $cm^3$) and best resistance to oxidation of these three compounds.

It is known that $TiAl_3$ has an ordered, body-centered tetragonal crystal structure with crystal lattice parameters of a=0.384 nm and c=0.8596 nm, a crystal configuration commonly denoted $DO_{22}$. The brittleness of $TiAl_3$ is caused mainly by this complex crystal structure, which affords insufficient slip systems to promote ductility. It has been suggested in the art that this undesirable brittleness may be ameliorated by transforming the $DO_{22}$ crystal structure of $TiAl_3$ to an ordered, face-centered cubic $L1_2$ crystal structure, which has the necessary quantity of slip systems to permit ductile behavior.

Previous efforts at achieving ductility through the transformation of several ternary, or even quaternary, alloyed $TiAl_3$-based intermetallics, incorporating Cr and Mn, among others, have met with some success. But all previous efforts have been based at least in part upon the assumption that, during crystal transformation, the ternary alloying element substitutes for Al. This assumption is contrary to the atomic radius ratio criterion formulated by Messrs. Van Vucht and Buschow for rare-earth trialuminides. According to the atomic radius ratio criterion, in an $AB_3$-type rare-earth trialuminide, the structure becomes more hexagonal as the atomic radius ratio ($r_A/r_B$) increases. Assuming the same criterion holds true for transition metal trialuminides, the addition of Cr, Fe, Ni, Mn and the like (which have smaller radii than Al) likely transforms $TiAl_3$ into a non-cubic structure, rather than the ordered, cubic structure reported in the art.

In $AB_3$-type ordered intermetallics, alloying variables such as electron concentration (e/a) and atomic radius ratio are known to affect crystal structure; it has been indicated in the art that a transition from the ordered cubic structure to ordered hexagonal structure occurs as the e/a is increased. A similar transition has previously been observed by Van Vucht and Buschow when $r_A/r_B$ is increased in rare earth trialuminides.

In the present invention, electron concentration shall be taken to mean the average, per atom, of the number of electrons outside inert gas shells. Accordingly, an increase in e/a ordinarily would be expected on addition into $TiAl_3$ of ternary alloying elements such as Cr, Mn, Fe, Co, Ni, Cu, or Zn, because these elements have a greater number of electrons than either Ti or Al at their outer inert shells. If the e/a criteria is assumed to be valid for ternary $L1_2$-type titanium aluminides, the formation of ordered hexagonal structures, rather than of the ordered cubic structures reported in the art, would be expected.

This apparent inconsistency potentially could be explained by considering electron density to be "the number of electrons, per atom, in excess of the last complete shell." Using such a redefinition, and since the e/a of these elements corresponds to zero for Fe, Co, and Ni, one for Cu, and two for Zn, addition of these elements to $TiAl_3$ will reduce the electron concentration, resulting in cubic structures. Thus, within this redefinition, the $L1_2$-type structures observed in $TiM_xAl_{3-x}$, where M is either Fe, Co, Ni, Cu or Zn and x varies from 8 to 12.5 atomic weight percent, can be explained by the reduction in electron concentration.

Nevertheless, such a redefinition of electron concentration does not rationalize the observed $L1_2$ phases in Ti—Al—Cr and Ti—Al—Mn systems reported in the art; the high electron densities for Cr and Mn would be expected to lead to ordered hexagonal structures.

The invention resolves this apparent conflict by using the atomic radius criterion as the effective alloy variable in $L1_2$-type ternary titanium aluminides. The invention establishes that the ternary alloying element, e.g., Cr, Fe, Mn, Ni, substitutes for titanium rather than aluminum, as previously assumed in the art. A decrease in atomic radius results, due to titanium's having a larger Goldschmidt atomic radius than the added ternary elements. The decrease in atomic radius promotes the formation of cubic structures and explains the presence of the ordered cubic structures in these ternary titanium aluminides. One can conclude therefrom that $L1_2$-type titanium aluminides are not $TiAl_3$-based, as commonly assumed in the art, but rather are $TiAl_2$-based intermetallics. From these conclusions, novel ternary alloys of the Ti—Al—Ni and Ti—Al—Fe systems have been formulated and prepared.

An important feature of the alloys of the invention is their two-phase composition. Actual samples of the compositions $Ti_{30}Fe_4Al_{66}$ and $Ti_{30}Ni_4Al_{66}$ were prepared and evaluated using X-ray powder diffraction techniques. The evaluations confirmed that the compositions were dual phase, with both $TiAl_2$ and $L1_2$ phases observed. While physical demonstration of only the Ti—Fe—Al and Ti—Ni—Al ternary systems was accomplished, the underlying rationale described above is applicable to other $L1_2$ type ternary titanium aluminides systems as well, e.g. $Ti_{25}X_9Al_{66}$ and $Ti_{25}X_8Al_{67}$, where X may be chromium, copper, iron, manganese, nickel, palladium, cobalt, silver, and gold.

The invention of a two-phase (as opposed to single-phase) titanium aluminide alloy with appreciable ductility bears important implications for industry. Previously composed ternary alloys of the titanium aluminides generally have exhibited a single-phase $L1_2$ crystal structure. The presence in the invention of a fine, two-phase microstructure is indicative of improved material creep properties, another requirement of high-temperature applications. Such a property in the alloys of the invention also permits the use of heat-treatment or thermomechanical treatment to improve the overall mechanical properties of the material.

A second feature of the alloys of the invention is their hardness. Most of the single-phase $Li_2$-type ternary alloys of the titanium aluminides known in the art have been reported to have Vickers hardness numbers of around 150–200. The samples of the invention prepared and tested exhibited Vickers hardness numbers of around 350,. indicating advantageous high-temperature mechanical properties.

EXAMPLES (INDUSTRIAL APPLICABILITY)

The invention is further illustrated by the following nonlimiting examples.

EXAMPLE ONE

Six 100-gram alloy buttons of the compositions $Ti_{34-x}Fe_xAl_{66}$ and $Ti_{34-x}Ni_xAl_{66}$ (x=1, 4, 8 at %) were prepared by arc melting of high-purity metals in an argon atmosphere on a water-cooled copper hearth. To maximize homogeneity, the alloys were remelted several times. After the final cast, the samples were reweighed. A weight loss of less than 0.02% was indicated, justifying an assumption that the proportional compositions were unchanged by the serial melts.

Thirty-gram samples of the alloys were then annealed for ten days at 1300° K. in a vacuum of $1\times10^{-5}$ torr and then furnace cooled. Each sample was pulverized to <325 mesh, wrapped in high purity Ti foils, and annealed at 973° K. for four hours in a vacuum of $1\times10^{-5}$ torr. X-ray powder diffraction (XRD) patterns were obtained with a computer-controlled Philips diffractometer using $CuK_{alpha}$ radiation. All patterns were obtained at a speed of 1° $min^{-1}$ with a step scan size of 0.05°.

Metallographic examination of the samples was performed using optical metallography and scanning electron microscopy. Microhardness measurements (a measure of ductility) were obtained at 1 kg load with a dwell time of 15 seconds.

A summary of the phases observed by XRD analysis and microhardness values (Vickers hardness number) of the resulting ternary Al—Al—Fe and Al—Ti—Ni alloys, annealed at 1300 K. for ten days, is set forth in Table I. The alloys composed of 1 at % Fe or Ni are primarily single-phase $TiAl_2$. However, as the amount of the ternary element Fe or Ni was increased to 4 at %, a two phase microstructure of $TiAl_2$ and $L1_2$ was observed.

TABLE I

| Alloy | Phases | VHN(1 kg 15s) |
|---|---|---|
| $Ti_{33}Fe_1Al_{66}$ | $TiAl_2$ | 393 |
| $Ti_{33}Ni_1Al_{66}$ | $TiAl_2$ | 390 |
| $Ti_{30}Fe_4Al_{66}$ | $TiAl_2$, $L1_2$ | 343 |
| $Ti_{30}Ni_4Al_{66}$ | $TiAl_2$, $L1_2$ | 368 |
| $Ti_{26}Fe_8Al_{66}$ | $L1_2$ | 257 |
| $Ti_{26}Ni_8Al_{66}$ | $L1_2$ | 287 |

X-ray powder diffraction data for the two alloys is set forth in Table II and Table III. Further increase of the ternary element Fe or Ni lead to primarily single phase microstructure of $L1_2$. As noted in Table I, the microhardness of the invented alloys decreases from 390 to 260 with increasing ternary alloying element Fe or Ni. The microhardness values of the primarily single-phase $TiAl_2$ alloys was lower than that of $TiA_{13}$, which has been reported in the art to be approximately 500 at 25 g load. Similarly, the microhardness of the single phase $L1_2$ alloys was found to be higher than the values (about 200) previously reported in the art.

TABLE II

| $\sin^2\theta_{obs}$ | $\sin^2\theta_{calc}$[a] | Reflection | $I/I_o$ (%) | Phase |
|---|---|---|---|---|
| 0.0383 | 0.0381 | 001 | 4 | $L1_2$ |
| 0.0387 | 0.0387 | 011 | 4 | $TiAl_2$ |
| 0.0763 | 0.0761 | 011 | 2 | $L1_2$ |
| 0.0870 | 0.0869 | 017 | 3 | $TiAl_2$ |
| 0.1116 | 0.1116 | 116 | 100 | $TiAl_2$ |
| 0.1144 | 0.1142 | 111 | 58 | $L1_2$ |
| 0.1174 | — | — | 3 | [d] |
| 0.1190 | 0.1191 | 019 | 2 | $TiAl_2$ |
| 0.1447 | 0.1447 | 0012 | 20 | $TiAl_2$ |
| 0.1509 | 0.1508 | 020 | 33 | $TiAl_2$ |
| 0.1524 | 0.1523 | 002 | 31 | $L1_2$ |
| 0.1907 | 0.1904 | 012 | 2 | $L1_2$ |
| 0.2075 | 0.2075 | 0113 | 2 | $TiAl_2$ |
| 0.2884 | 0.2890[b] | | 2 | $TiAl_3$ |
| 0.2955 | 0.2955 | 0212 | 19 | $TiAl_2$ |
| 0.3019 | 0.3015 | 220 | 11 | $TiAl_2$ |
| 0.3051 | 0.3046 | 022 | 14 | $L1_2$ |
| 0.3976 | 0.3979[c] | 113 | 3 | Al |
| 0.4012 | 0.4010 | 1118 | 9 | $TiAl_2$ |
| 0.4134 | 0.4131 | 136 | 18 | $TiAl_2$ |
| 0.4196 | 0.4188 | 113 | 14 | $L1_2$ |
| 0.4467 | 0.4463 | 2212 | 8 | $TiAl_2$ |
| 0.4576 | 0.4569 | 222 | 5 | $L1_2$ |

[a]For $TiAl_2$, $\sin_2\theta_{calc}$ is taken from H. Mabuchi, et al., where a = 0.3971 nm and c = 2.432 nm; for $L1_2$ it is calculated from experimentally determined lattice constant a = 3.951 + 0.002 nm.
[b]From JCPDS No. 371449.
[c]From JCPDS No. 40787.
[d]Unidentified.

TABLE III

| $\sin^2\theta_{obs}$ | $\sin^2\theta_{calc}$[a] | Reflection | $I/I_o$ (%) | Phase |
|---|---|---|---|---|
| 0.0386 | 0.0384 | 001 | 4 | $L1_2$ |
| 0.0868 | 0.0869 | 017 | 2 | $TiAl_2$ |
| 0.1115 | 0.1115 | 116 | 100 | $TiAl_2$ |
| 0.1149 | 0.1151 | 111 | 36 | $L1_2$ |
| 0.3660 | — | — | 3 | [c] |
| 0.1444 | 0.1447 | 0012 | 18 | $TiAl_2$ |
| 0.1510 | 0.1508 | 002 | 26 | $TiAl_2$ |
| 0.1532 | 0.1537 | 002 | 17 | $L1_2$ |
| 0.1599 | 0.1600[b] | | 3 | $TiAl_3$ |
| 0.1921 | 0.191 | 012 | 3 | $L1_2$ |
| 0.2955 | 0.2955 | 0212 | 16 | $TiAl_2$ |
| 0.3020 | 0.3015 | 220 | 9 | $TiAl_2$ |
| 0.3072 | 0.3070 | 022 | 8 | $L1_2$ |
| 0.4009 | 0.4010 | 1118 | 9 | $TiAl_2$ |
| 0.4138 | 0.4131 | 136 | 14 | $TiAl_2$ |
| 0.4224 | 0.4222 | 113 | 7 | $L1_2$ |
| 0.4468 | 0.4463 | 2212 | 7 | $TiAl_2$ |
| 0.4610 | 0.4605 | 222 | 2 | $L1_2$ |

[a]For $TiAl_2$, $\sin^2\theta_{calc}$ is taken from H. Mabuchi, et al., where a = 0.3971 nm, c = 2.432 nm; for $L1_2$ it is calculated from experimentally determined lattice constant a = 0.3935 ± 0.004 nm.
[b]From JCPDS No. 371449.
[c]Unidentified.

EXAMPLE TWO

The alloys $Ti_{30}Fe_4Al_{66}$ and $Ti_{30}Ni_4Al_{66}$ were prepared from high purity elemental constituents by vacuum arc melting, and remelted several times to ensure homogeneity. As-cast alloys were then homogenized at 1227° C. for 36 hours and then furnace cooled. Indentation measurements were made at 20 kg loads. Analysis of the microstructure showed crack-free samples with extensive flow around the indentations. Metallographic examination of the samples indicated two-phase microstructure, consisting mainly of $TiAl_2$ and an $L1_2$ type ternary titanium aluminide of Fe or Ni.

To our knowledge, such ductility in these ternary alloys has not previously been known in the art. This lack of prior knowledge in the art is thought to be due to the initial assumption of previous studies, i.e. that transformation of these alloys occurs via the $DO_{22}$ structure of $TiAl_3$ to $L1_2$, an assumption which would discourage the design of these two alloys. Our preparation and evaluation of the alloys confirms that the transformation instead is from $TiAl_2$ to $L1_2$. The alloys of the invention display desirable ductility when compared to other similar alloys in the art. This improved ductility is due at least in part to the fact that these alloys exhibit a two-phase mixture in the microstructure, rather than single phase; the two-phase character may contribute added creep resistance in comparison to the alloys known in the art.

Although the invention has been described with reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above, and of the corresponding application are hereby incorporated by reference.

What is claimed is:

1. A titanium aluminide composition having the formula $Ti_aX_bAl_c$ exhibiting a two-phase microstructure of tetragonal $TiAl_2$ and face-centered cubic type ternary titanium aluminide;

wherein X comprises at least one member selected from the group consisting of iron, cobalt, nickel, copper, palladium, silver, and gold; and wherein a is between approximately 25 and 35 atomic weight percent, inclusive, b is less than 5 atomic weight percent, and c is between approximately 60 and 70 atomic weight percent, inclusive.

2. The composition of claim 1 wherein a comprises thirty atomic weight percent, b is four atomic weight percent, and c is sixty-six atomic weight percent.

3. The composition of claim 1 having a Vickers Hardness Number between approximately 343 and approximately 393.

4. The composition of claim 2 wherein X comprises nickel.

5. The composition of claim 2 wherein X comprises iron.

6. The composition of claim 3 having a Vickers Hardness Number of approximately 343.

7. The composition of claim 3 having a Vickers Hardness Number of approximately 368.

* * * * *